US008794446B2

(12) United States Patent
Blendinger et al.

(10) Patent No.: US 8,794,446 B2
(45) Date of Patent: Aug. 5, 2014

(54) SPARGING DEVICE FOR A FLOTATION CELL

(75) Inventors: Stefan Blendinger, Fürth (DE); Robert Fleck, Adelsdorf (DE); Gerold Franke, Nürnberg (DE); Lilla Grossmann, Erlangen (DE); Werner Hartmann, Weisendorf (DE); Wolfgang Krieglstein, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/814,050

(22) PCT Filed: Apr. 19, 2011

(86) PCT No.: PCT/EP2011/056223

§ 371 (c)(1),
(2), (4) Date: Feb. 4, 2013

(87) PCT Pub. No.: WO2012/016721

PCT Pub. Date: Feb. 9, 2012

(65) Prior Publication Data

US 2013/0134101 A1 May 30, 2013

(30) Foreign Application Priority Data

Aug. 4, 2010 (EP) ..... 10171860

(51) Int. Cl.
*B03D 1/24* (2006.01)
*B01F 3/04* (2006.01)

(52) U.S. Cl.
USPC ..... 209/164; 209/170; 261/124

(58) Field of Classification Search
USPC ..... 209/170; 261/124
See application file for complete search history.

(56) References Cited

U.S. PATENT DOCUMENTS

| | | | | |
|---|---|---|---|---|
| 1,268,630 | A * | 6/1918 | Ruth | 209/169 |
| 1,526,596 | A * | 2/1925 | Greenawalt | 209/169 |
| 1,579,355 | A * | 4/1926 | Greenawalt | 209/169 |
| 1,583,591 | A | 5/1926 | Greenawalt | 261/87 |
| 2013/0134101 | A1 | 5/2013 | Blendinger et al. | 210/703 |

FOREIGN PATENT DOCUMENTS

| | | | |
|---|---|---|---|
| GB | 1272047 A | 4/1972 | B01F 3/04 |
| WO | 2006/069995 A1 | 7/2006 | B03D 1/02 |
| WO | 2012/016721 A1 | 2/2012 | B01F 3/04 |

OTHER PUBLICATIONS

International Search Report and Written Opinion, Application No. PCT/EP2011/056223, 15 pages, Aug. 31, 2011.

* cited by examiner

*Primary Examiner* — Thomas M Lithgow
(74) *Attorney, Agent, or Firm* — King & Spalding L.L.P.

(57) ABSTRACT

A sparging device for a flotation cell may include a central gas tube with a central gas orifice which is adjoined by at least two connecting tubes each having a connecting gas orifice, the connecting tubes being aligned at a right angle ss to a longitudinal axis LZ of the central gas tube, the central gas orifice being connected to the connecting gas orifices, and each connecting tube being connected to at least one gas injection unit at its end remote from the central gas tube. A flotation cell with such a sparging device and a flotation method are also disclosed.

10 Claims, 5 Drawing Sheets

SPARGING DEVICE FOR A FLOTATION CELL

CROSS-REFERENCE TO RELATED APPLICATIONS

This application is a U.S. National Stage Application of International Application No. PCT/EP2011/056223 filed Apr. 19, 2011, which designates the United States of America, and claims priority to EP Patent Application No. 10171860.9 filed Aug. 4, 2010. The contents of which are hereby incorporated by reference in their entirety.

TECHNICAL FIELD

The disclosure relates to a sparging device for a flotation cell, to a flotation cell equipped with at least one sparging device of said kind, and to a method for separating particles of a valuable resource from a suspension by flotation.

BACKGROUND

Flotation is a physical separation process for separating fine-grained solid mixtures, such as ores and tailings for example, in an aqueous slurry or suspension with the aid of air bubbles on the basis that the particles contained in the suspension possess a different surface wettability. Flotation is employed for conditioning natural resources found in the earth and in the processing of preferably mineral substances having a low to medium content of a usable component or a valuable resource, for example in the form of nonferrous metals, iron, rare earth metals and/or noble metals as well as non-metallic natural resources.

WO 2006/069995 A1 describes a pneumatic flotation cell having a housing comprising a flotation chamber, with at least one nozzle arrangement, referred to here as ejectors, additionally with at least one sparging device, referred to as aeration devices or aerators when air is used, as well as a collecting tank for a foam product formed in the course of the flotation process.

In pneumatic flotation, a suspension composed of water and fine-grained solid matter to which reagents have been added is generally injected into a flotation chamber by way of at least one nozzle arrangement. The desired effect to be achieved by the reagents is that in particular the valuable particles or valuable resource particles in the suspension that are preferably to be separated are rendered hydrophobic. In most cases xanthates are used as reagents, in particular in order to selectively hydrophobize sulfide ore particles. Simultaneously with the suspension, the at least one nozzle arrangement is fed with gas, in particular air, which comes into contact with the hydrophobic particles in the suspension. The hydrophobic particles adhere to gas bubbles that form, such that the gas bubble structures, also referred to as aeroflocks, float to the top and form the foam product on the surface of the suspension. The foam product is discharged into a collecting tank and typically also thickened.

The quality of the foam product or the degree of success of the flotation separation method is dependent inter alia on the collision probability between a hydrophobic particle and a gas bubble. The higher the collision probability, the greater is the number of hydrophobic particles that will adhere to a gas bubble, ascend to the surface and form the foam product together with the particles.

In this case a preferred diameter of the gas bubbles is less than approximately 5 mm and lies in particular in the range between 1 and 5 mm. Such small gas bubbles have a high specific surface area and are therefore able to bind and entrain considerably more valuable resource particles, in particular ore particles, per volume of gas used than larger gas bubbles.

Gas bubbles having a larger diameter generally rise faster than gas bubbles of smaller diameter. In the process the smaller gas bubbles are gathered up by larger gas bubbles and aggregate with the latter to form even larger gas bubbles. This results in a reduction in the available specific surface area of the gas bubbles in the suspension to which the valuable resource particles are able to bind.

In flotation cells embodied in the shape of a column, in which a diameter of the flotation chamber is less by a multiple than its height, the distance that a gas bubble has to travel in the suspension or the flotation chamber in order to reach the surface of the suspension is particularly great. Due to the particularly long distance traveled, particularly large gas bubbles are produced in the suspension. The specific yield of valuable resource particles from the suspension decreases as a result, and consequently the efficiency of the flotation cell is also reduced.

In implementations referred to as hybrid flotation cells, which represent a combination of a pneumatic flotation cell with a flotation cell embodied in the shape of a column, larger valuable resource particles having particle diameters in the range of 50 μm and greater in particular do not bind fully to the gas bubbles present and so can only be partially separated from the suspension. In contrast, fine fractions with particle diameters in the range of 20 μm and less are precipitated particularly well.

In order to ensure that gas bubbles having a diameter in the range of 1 to 5 mm are present continuously over the height of the flotation chamber in a flotation cell embodied in a column shape, it is necessary to reduce the diameters of the gas bubbles generated in the lower section of the flotation chamber or by means of a sparging device in the flotation chamber. In certain conventional flotation treatment solutions use is made of sparging devices having gas outlet orifices whose diameters range from 3 to 5 mm and which lead in column-shaped flotation cells to a gas bubble formation having gas bubbles that are much too large, in particular greater than 5 mm in diameter.

Any further reduction in the diameters of the gas outlet orifices of sparging devices is virtually impossible in practice. Consequently, gas outlet orifices having diameters of up to 1 mm on sparging devices easily become clogged when suspensions that are typically to be processed having a solid matter content in the range of 30 to 40% are used. Even during short downtimes of the flotation cell, particles from the suspension infiltrate the gas outlet orifices and block them. When the cell is restarted, the pressure of the gas that is to be introduced into the suspension is frequently insufficient to flush out such small gas outlet orifices of a sparging device so that they are free again.

It is all the more important for this reason to take measures already at the injection point in order to prevent the gas bubbles injected into the suspension from combining to form large gas bubbles.

U.S. Pat. No. 1,583,591 describes an arrangement for treating liquids with gases and for use in the flotation treatment of ores, wherein an atomizer, or rotary gas diffusion member, is used.

GB 1272047 describes an air sparging device for aerating effluent slurries, said device comprising a cylindrical chamber which has an inlet opening at one end thereof for feeding oxygen or air thereto, and in addition has a plurality of outlet openings, each outlet opening comprising a conduit extending radially from the wall of the chamber and having a transverse cross-sectional area less than the cross-sectional area of the chamber. The air sparging device may be used in a rotating mode of operation in order to improve the aerating action.

However, rotating parts in the suspension are subjected to increased wear and tear, in particular in the flotation treatment of suspensions having a high solid matter fraction, such as in the flotation of ores.

SUMMARY

One embodiment provides a sparging device for a flotation cell, comprising a central gas conduit having a central gas orifice to which are connected at least two connecting tubes, each having a connecting gas orifice, wherein the connecting tubes are aligned at a right angle to a longitudinal axis LZ of the central gas conduit, wherein the central gas orifice is connected to the connecting gas orifices, and wherein at its end facing away from the central gas conduit each connecting tube is connected to at least one gas injection unit, wherein each gas injection unit comprising a gas feed tube having a gas feed orifice and a gas distributor is embodied with a gas distributor chamber into which the gas feed orifice leads, wherein the gas distributor additionally comprises a number of gas distributor nozzles, each having at least one tubular nozzle orifice and at least one gas outlet orifice, wherein each nozzle orifice is connected on one side to the gas distributor chamber and on the other side to at least one gas outlet orifice at an end of the gas distributor nozzle facing away from the gas feed tube, wherein the gas distributor nozzles are arranged equidistantly from one another around a longitudinal axis of the gas feed tube, viewed in the direction of said longitudinal axis, and a longitudinal axis of each nozzle orifice is aligned at an angle of less than 90° to the longitudinal axis of the gas feed tube in the direction of the end of the gas feed tube facing away from the gas distributor, and wherein the connecting gas orifices are connected to the nozzle orifices.

In a further embodiment, the longitudinal axis of each nozzle orifice is aligned at an angle in the range of 30° to 70°, e.g., at an angle of 45°, to the longitudinal axis of the gas feed tube.

In a further embodiment, per gas distributor nozzle the longitudinal axis of the nozzle orifice and the longitudinal axis of the gas feed tube are arranged in one plane.

In a further embodiment, each gas outlet orifice has a diameter in the range of 1 to 5 mm.

In a further embodiment, two connecting tubes in each case are arranged opposite each other at the central gas conduit and symmetrically with respect to the longitudinal axis of the central gas conduit.

In a further embodiment, the longitudinal axis of each gas feed tube is aligned at an angle, e.g., a right angle, to a longitudinal axis of the respective connecting tube.

Another embodiment provides a flotation cell, e.g., a column-shaped flotation cell or hybrid flotation cell, comprising a housing having a flotation chamber, at least one nozzle arrangement for feeding gas and a suspension into the flotation chamber, as well as at least one sparging device as disclosed above for further feeding of gas into the flotation chamber, wherein each gas injection unit is arranged in said manner in the flotation chamber underneath the at least one nozzle arrangement.

In a further embodiment, the central gas conduit is arranged vertically and the connecting tubes are arranged horizontally in the flotation chamber.

Another embodiment provides a method for separating valuable resource particles, in particular ore minerals, by flotation from a suspension having a solid matter content in the range of 20 to 60% while forming a foam product by means of a flotation cell as disclosed above, wherein at least some of the gas outlet orifices are aligned counter to a local direction of movement R of the suspension in the housing, and wherein the longitudinal axes of the gas feed tubes are aligned at an angle of 0° to max. 90° to the local direction of movement of the suspension in the housing.

In a further embodiment, the longitudinal axes of the gas feed tubes are arranged at an angle in the range of 0° to 20° to the local direction of movement of the suspension in the housing and oppositely directed thereto.

BRIEF DESCRIPTION OF THE DRAWINGS

Exemplary embodiments will be explained in more detail below on the basis of the schematic drawings, wherein.

DETAILED DESCRIPTION

Figure 1:
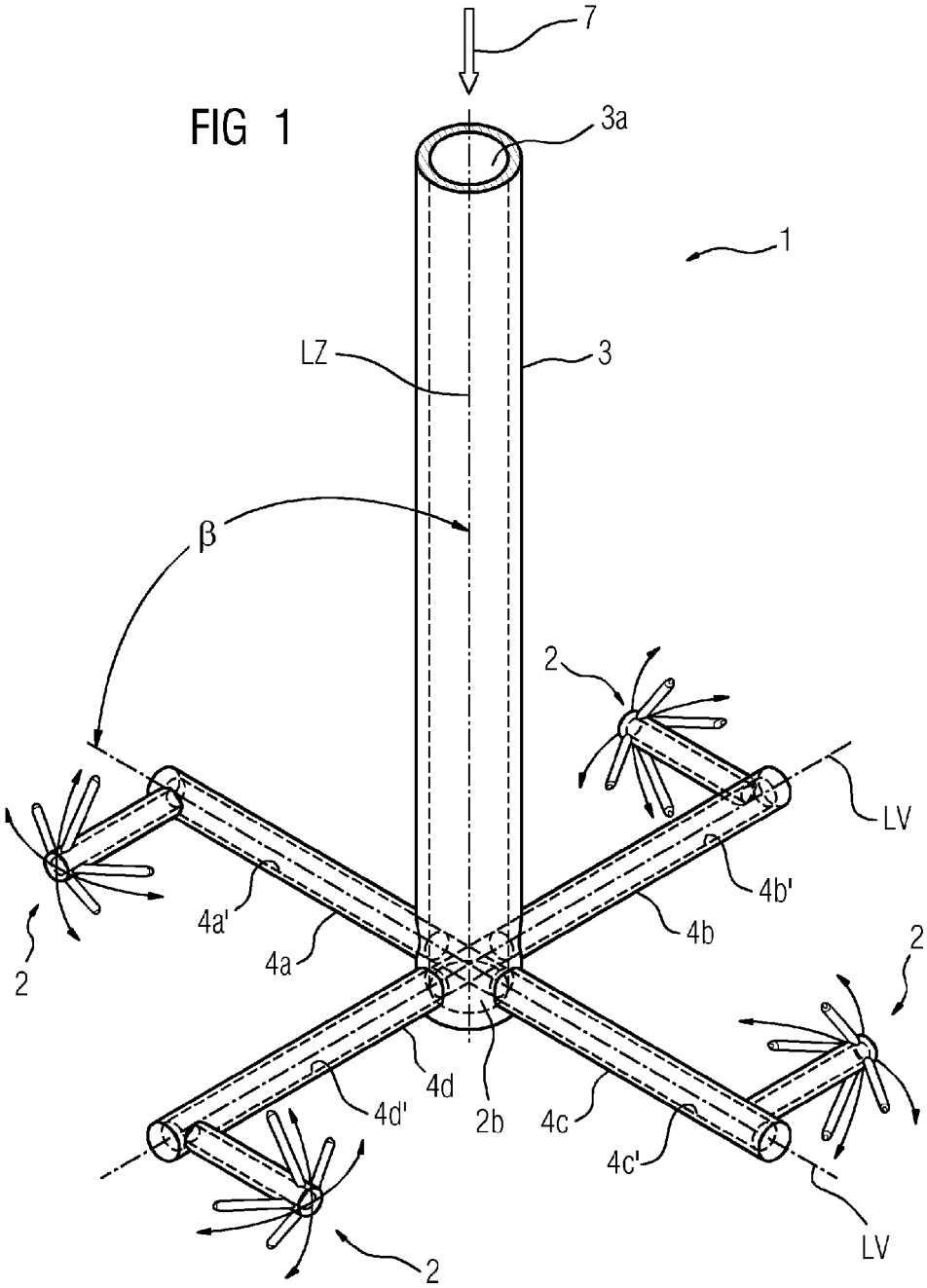
FIG. 1 shows a first sparging device in a three-dimensional view.

Embodiments of the present disclosure provide a sparging device that has been improved to the extent that it is capable of distributing injected gas particularly finely in the suspension, and furthermore to disclose a flotation cell having a sparging device of said kind and a method for the operation thereof.

Some embodiments provide a sparging device for a flotation cell, comprising a central gas conduit having a central gas orifice, to which central gas conduit are connected at least two connecting tubes, each having a connecting gas orifice, wherein the connecting tubes are aligned at a right angle β to a longitudinal axis LZ of the central gas conduit, wherein the central gas orifice is connected to the connecting gas orifices, and wherein at its end facing away from the central gas conduit each connecting tube is connected to at least one gas injection unit, wherein each gas injection unit comprising a gas feed tube having a gas feed orifice and a gas distributor is embodied with a gas distributor chamber into which the gas feed orifice leads, wherein the gas distributor additionally has a plurality of gas distributor nozzles, each having at least one tubular nozzle orifice and at least one gas outlet orifice, wherein each nozzle orifice is connected on one side to the gas distributor chamber and on the other side to at least one gas outlet orifice at an end of the gas distributor nozzle facing away from the gas feed tube, wherein the gas distributor nozzles, viewed in the direction of a longitudinal axis L1 of the gas feed tube, are arranged at a uniform distance from one another around said longitudinal axis L1 and a longitudinal axis of each nozzle orifice is aligned at an angle α of less than 90° to the longitudinal axis L1 of the gas feed tube in the direction of the end of the gas feed tube facing away from the gas distributor, and wherein the connecting gas orifices are connected to the nozzle orifices.

The arrangement of the gas outlet orifices of the gas injection unit enables a gas to be injected into a suspension in a particularly finely distributed manner in a direction counter to a direction of movement R of said suspension. This ensures an intensive mixing of suspension and gas bubbles, resulting in a significant increase in the yield of a flotation cell that is equipped with at least one sparging device. At the same time it is possible to insert the sparging device into a flotation chamber without the need to fixedly secure the device in the region of the housing of the flotation cell. No rotating parts are present or necessary in this arrangement in order to introduce the gas into the suspension in an optimal manner.

It has proven worthwhile here for the longitudinal axis L2, L2' of each nozzle orifice and the longitudinal axis L1 of the gas feed tube to be aligned with respect to one another at an angle α in the range of 30° to 70°, in particular at an angle α of 45°.

In this case the longitudinal axis L2, L2' of the nozzle orifice and the longitudinal axis L1 of the gas feed tube can lie in one plane per gas distributor nozzle. In some embodiments, the longitudinal axis L2, L2' of each nozzle orifice and the longitudinal axis L1 of the gas feed tube, although aligned at an angle α in the range of 30° to 70°, e.g., at an angle α of 45°, with respect to one another, are not arranged in one plane. If in this arrangement a center point of the transverse cross-sectional area of one of the nozzle orifices at the transition into the gas distributor chamber is considered in alignment with the longitudinal axis L1 of the gas feed tube, the gas outlet orifice lies to the side of the longitudinal axis L1 of the gas feed tube, wherein the longitudinal axis L1 of the gas feed tube and the longitudinal axis L2, L2' of the nozzle orifice in precisely this view delimit in particular an angle γ in the range of >0° to 60°. Such a tilted arrangement of all the nozzle orifices of a gas injection unit in the same direction causes a swirl to be superimposed on the gas flowing out of the gas injection unit, thereby producing a further improvement in the mixing of gas and suspension.

The gas distributor may have four gas distributor nozzles. This causes the gas to be intensively mixed into a suspension. It is however also possible to provide either just two or three or more than four gas distributor nozzles. In order to avoid the gas outlet orifices becoming clogged by particles from the suspension, each gas outlet orifice may have a diameter in the range of 1 to 5 mm. Depending on which size is chosen for the gas outlet orifices, only gas bubbles having a diameter in the range of 1 to 5 mm will be present in the suspension over the entire height of the flotation chamber, thus enabling an optimal separation of the valuable resource particles and allowing a high yield.

The connecting tubes in each case may be disposed opposite each other at the central gas conduit in a symmetrical arrangement with respect to the longitudinal axis LZ of the central gas conduit. This symmetrical embodiment variant stabilizes the desired position of the gas injection units in the flotation chamber.

The longitudinal axis L1 of a gas feed tube may be aligned at an angle, in particular a right angle, to a longitudinal axis LV of the respective connecting tube in such a way that an injection of gas via the gas outlet orifices is achieved counter to the direction of movement R of the suspension in the flotation chamber.

In this arrangement a gas injection unit may be swivel-mounted on a connecting tube in order to ensure rapid and uncomplicated adjustment and optimization of the position of the gas outlet orifices counter to the current direction of movement R of the suspension in a flotation chamber. This can be realized by means of an articulated joint which can be fixed in a chosen position and is arranged between connecting tube and gas injection unit, and the like.

The object is achieved for the flotation cell, in particular a column-shaped flotation cell or hybrid flotation cell, comprising a housing having a flotation chamber, at least one nozzle arrangement for feeding gas and a suspension into the flotation chamber, as well as at least one sparging device for further feeding of gas into the flotation chamber, wherein each gas injection unit is arranged in said manner in the flotation chamber underneath the at least one nozzle arrangement.

The flotation cell may ensure a high level of separation performance and consequently a high yield of valuable resource particles, because the at least one sparging device enables the setting of suitable diameters of the gas bubbles in the entire flotation chamber as well as a particularly thorough mixing of the generated gas bubbles with the suspension to be achieved.

The flotation cell may be a column-shaped flotation cell in which a diameter of the flotation chamber is less by a multiple than its height. In particular the cell is a hybrid flotation cell which is formed by a columnar flotation cell combined with a pneumatic flotation cell. The effect of a formation of gas bubbles having an excessive diameter, which is intensified here due to the column-like construction of said flotation cells, is counteracted by means of the disclosed sparging device. Existing flotation cells can easily be equipped with at least one sparging device and their performance can be increased as a result.

In one embodiment the housing of the flotation cell has a cylindrical housing section whose axis of symmetry is arranged vertically.

The central gas conduit may be arranged perpendicularly and the connecting tubes may be arranged horizontally in the flotation chamber. In this way a height adjustment of the position of the gas injection units inside the flotation chamber is quickly and effortlessly possible.

These measures lead to a good distribution of the gas and an intensive mixing of gas and suspension in a flotation cell.

Air or nitrogen may be employed as the gas introduced into a flotation chamber by means of the sparging device and/or the nozzle arrangement in the case of a pneumatic flotation cell.

Other embodiments provide a method for separating valuable resource particles, in particular ore minerals, by flotation from a suspension having a solid matter content in the range of 20 to 60% while forming a foam product by means of a flotation cell, wherein at least some of the gas outlet orifices are aligned counter to a local direction of movement R of the suspension in the housing, and wherein the longitudinal axes L1 of the gas feed tubes are aligned at an angle of 0° to max. 90° to the local direction of movement R of the suspension in the housing.

This permits an intensive commingling of the gas with the suspension while generating bubbles of particularly small diameter.

The longitudinal axes L1 of the gas feed tubes may be arranged at an angle in the range of 0° to 20° to the local direction of movement R of the suspension in the housing and oppositely directed thereto in order to intensify the commingling of gas bubbles and suspension even further.

Flotation treatment is applied in particular to suspensions having a solid matter content in the range of 30 to 40%.

FIG. 1 shows a first sparging device 1 in a three-dimensional view. The first sparging device 1 comprises a central gas conduit 3 having a central gas orifice 3*a*, to which central gas conduit 3 are connected in this case four connecting tubes 4*a*, 4*b*, 4*c*, 4*d*, each having a connecting gas orifice 4*a*', 4*b*', 4*c*', 4*d*'. In this arrangement the connecting tubes 4*a*, 4*b*, 4*c*, 4*d* are aligned at a right angle β to the longitudinal axis LZ of the central gas conduit 3. The central gas orifice 3*a* is connected to the connecting gas orifices 4*a*', 4*b*', 4*c*', 4*d*', wherein at its end facing away from the central gas conduit 3 each connecting tube 4*a*, 4*b*, 4*c*, 4*d* is connected to one gas injection unit 2 in each case (compare FIGS. 2 and 3).

Figure 2:
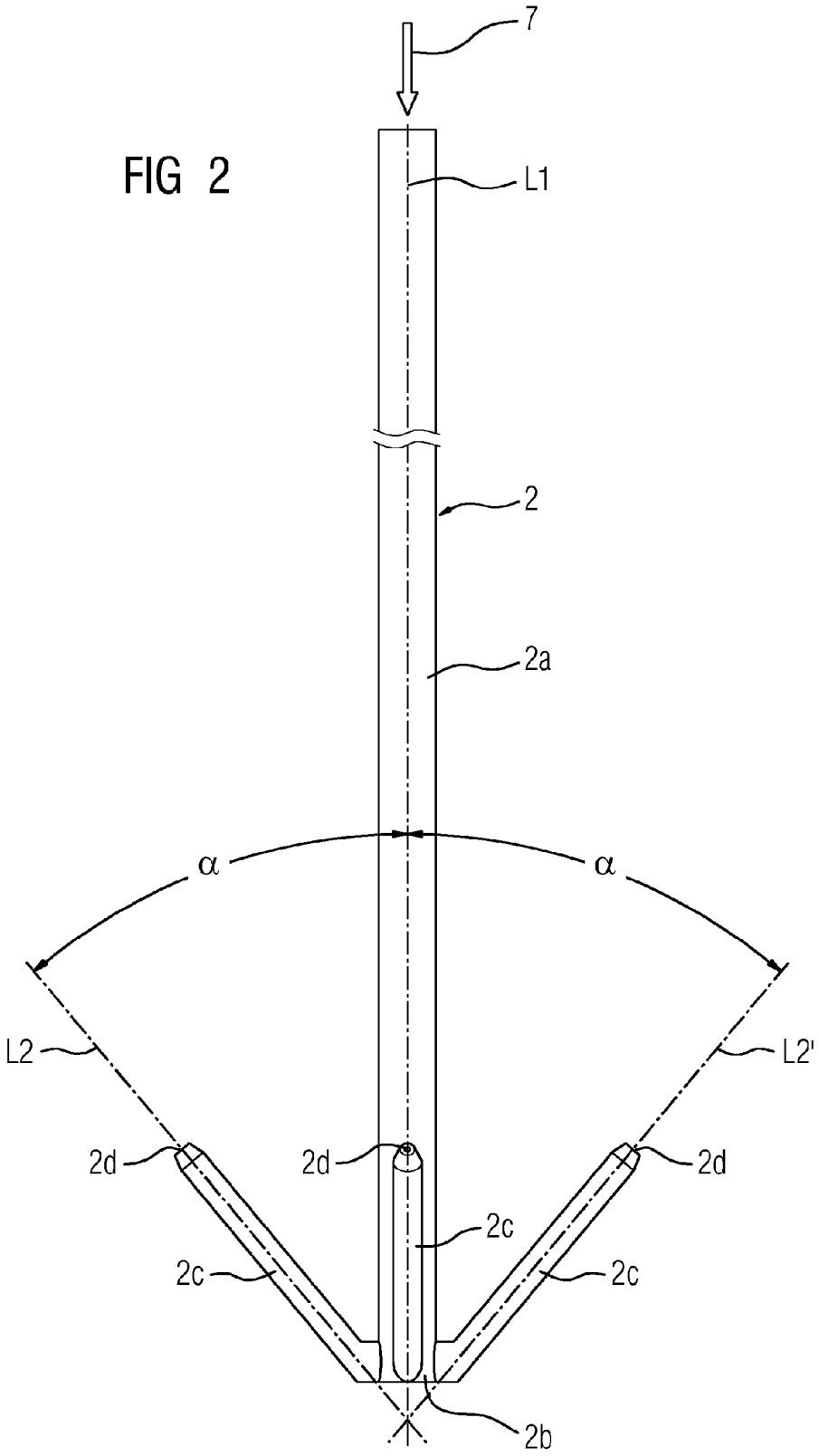
FIG. 2 shows the gas injection unit of the first sparging device according to FIG. 1 in a front view.
Figure 3:
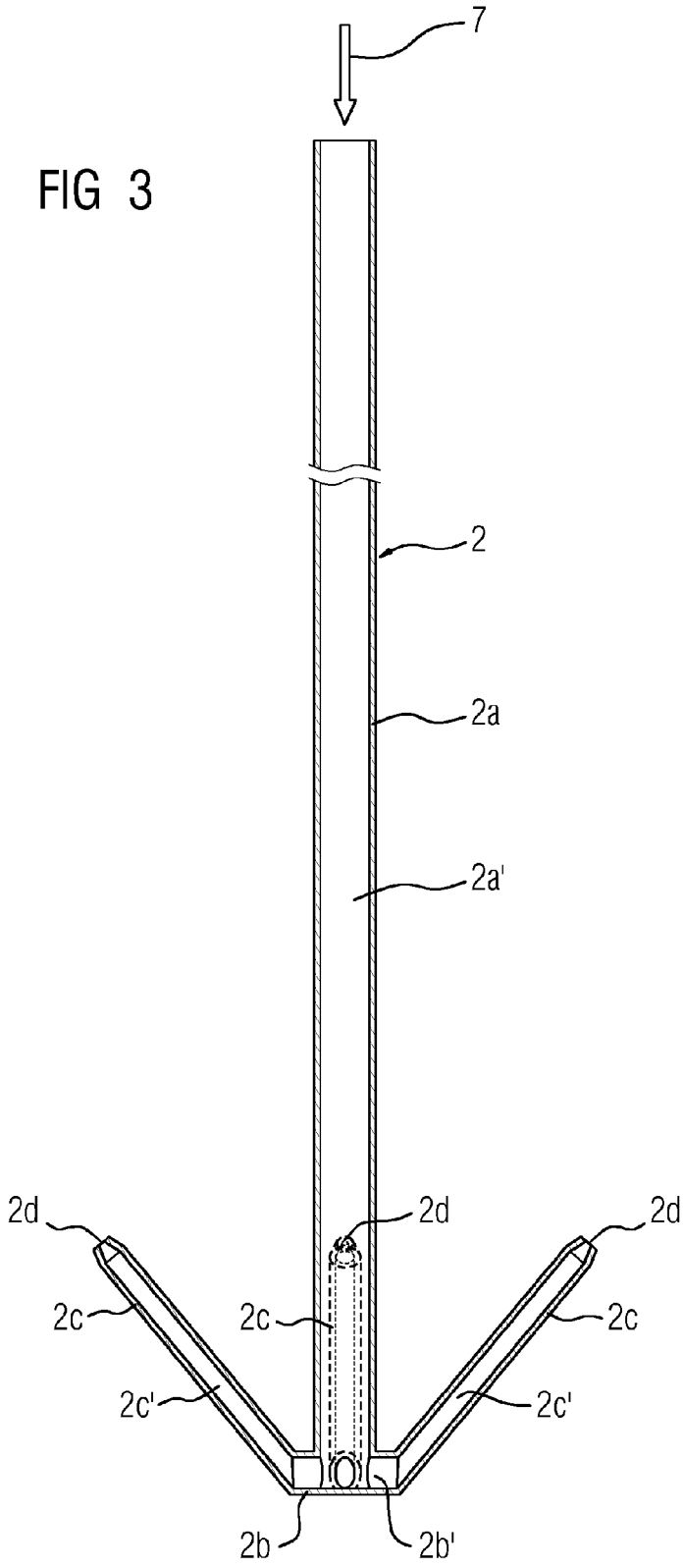
FIG. 3 shows the gas injection unit of the first sparging device according to FIG. 1 in a longitudinal section.

FIG. 2 shows a gas injection unit 2 in a front view. FIG. 3 shows the gas injection unit 2 according to FIG. 2 in a longitudinal section. The gas injection unit 2 comprises a gas feed tube 2*a* having a gas feed orifice 2*a*' and a gas distributor 2*b* having a gas distributor chamber 2*b*' into which the gas feed orifice 2*a*' leads. The gas distributor 2*b* additionally comprises four gas distributor nozzles 2*c*, each having a tubular nozzle orifice 2*c*' and a gas outlet orifice 2*d*, wherein each nozzle orifice 2*c*' is connected on one side to the gas distributor chamber 2*b*' and on the other side to a gas outlet orifice 2*d* at an end of the gas distributor nozzle 2*c* facing away from the gas feed tube 2*a*. Four gas distributor nozzles 2*c* are present here in total, these being grouped equidistantly from one another around the longitudinal axis L1 of the gas feed tube 2*a*, viewed in the direction of said axis. Two gas distributor nozzles 2*c* in each case are arranged opposite each other and symmetrically with respect to the longitudinal axis L1 of the gas feed tube 2*a*. A longitudinal axis L2, L2' of each nozzle orifice 2*c*' is aligned at an angle α of 45° to the longitudinal axis L1 of the gas feed tube 2*a* in the direction of the end of the gas feed tube 2*a* facing away from the gas distributor 2*b*. A gas 7 flowing into the gas feed tube 2*a* flows through the gas feed orifice 2*a*', reaches the gas distributor chamber 2*b*' and subsequently the nozzle orifices 2*c*', before finally flowing out via the gas outlet orifices 2*d*.

The connecting gas orifices 4*a*', 4*b*', 4*c*', 4*d*' are connected to the nozzle orifices 2*c*'. In this arrangement the gas injection units 2 can be swivel-mounted on the connecting tubes 4*a*, 4*b*, 4*c*, 4*d* (see arrows) such that an optimal spatial alignment and rapid adjustment of the positioning of the gas outlet orifices 2*d* is possible in relation to the helical direction of movement R of the suspension present in a flotation cell in the region of the gas outlet orifices 2*d*. In this case, insofar as the suspension moves in a helical manner from top to bottom in the flotation chamber 120 (compare FIG. 6), the gas injection units 2 may be aligned at an angle of approximately 20 to 30° upward with respect to the plane in which the distributor tubes are located.

When the sparging device 1 is used in a flotation cell, gas 7 is injected in a finely distributed manner into a suspension that is to be treated by a flotation process.

Figure 4:
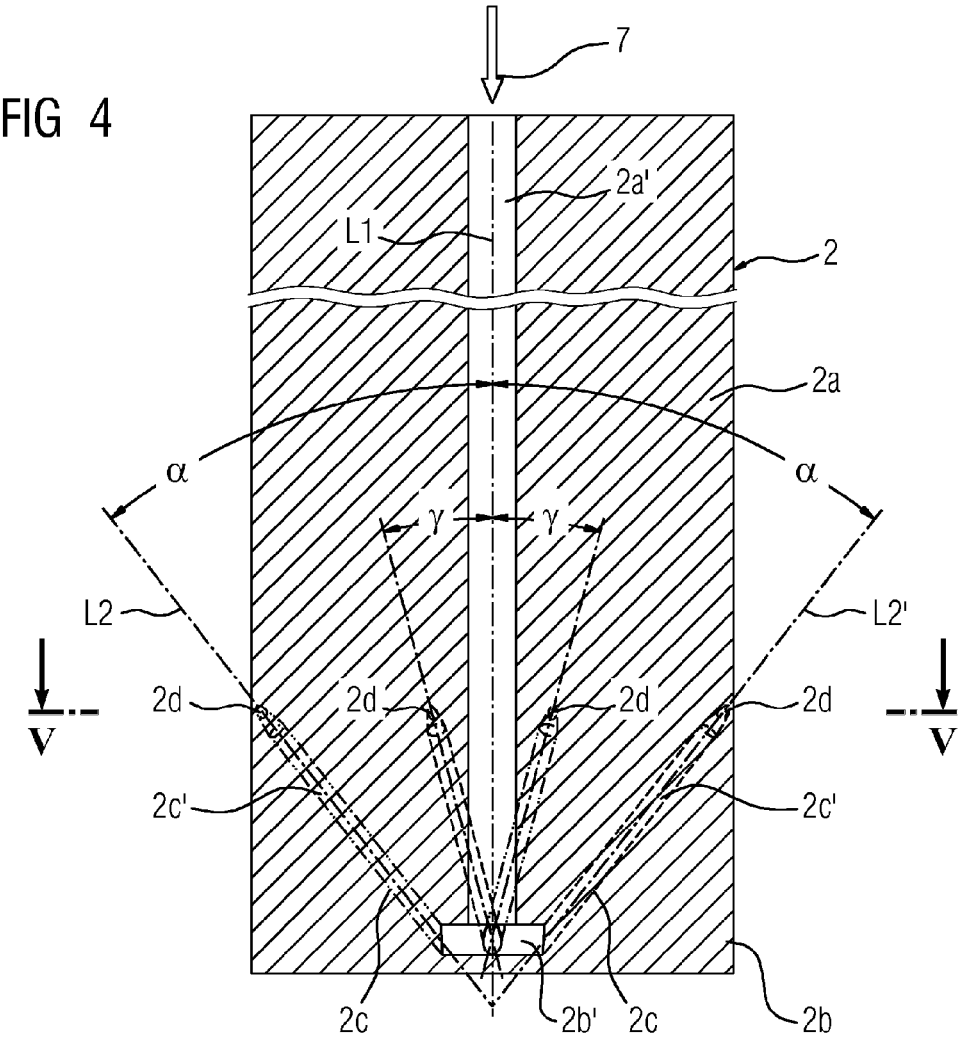
FIG. 4 shows a further gas injection unit in a longitudinal section.

FIG. 4 shows in a longitudinal section a further gas injection unit 2 which is implemented as a particularly robust embodiment variant and can be deployed as an alternative to the gas injection unit 2 according to FIGS. 1 to 3. Like reference signs as in FIGS. 1 to 3 designate like elements. The further gas injection unit 2 likewise comprises a gas feed tube 2*a* having a gas feed orifice 2*a*' and a gas distributor 2*b* having a gas distributor chamber 2*b*' into which the gas feed orifice 2*a*' leads. In this case, however, the gas feed tube 2*a* is closed on one side. The gas distributor 2*b* here comprises four gas distributor nozzles 2*c* integrated into the closed end of the gas feed tube 2*a*, each having a tubular nozzle orifice 2*c*' and a gas outlet orifice 2*d*, wherein each nozzle orifice 2*c*' is connected on one side to the gas distributor chamber 2*b*' and on the other side to a gas outlet orifice 2*d* at an end of the gas distributor nozzle 2*b* facing away from the gas feed tube 2*a*.

In an alternative embodiment variant a tapered gas feed tube 2*a* can also be used here and a cap can be placed onto its tip and secured, wherein the gas distributor chamber 2*b*', the gas distributor nozzles 2*c* having the nozzle orifices 2*c*', and the gas outlet orifices 2*d* are produced on the basis of the contour of the tip and the contour of the side of the cap facing toward the tip.

The longitudinal axis L2, L2' of each nozzle orifice 2*c*' and the longitudinal axis L1 of the gas feed tube 2*a* are aligned at an angle α of 45° to one another, as shown in FIGS. 1 to 3, though not in one plane. If a center point of the transverse cross-sectional area of one of the nozzle orifices 2*c* at the transition into the gas distributor chamber 2*b*' is considered in alignment with the longitudinal axis L1 of the gas feed tube 2*a*, the associated gas outlet orifice 2*d* lies to the side of the longitudinal axis L1 of the gas feed tube 2*a*, wherein the longitudinal axis L1 of the gas feed tube 2*a* and the longitudinal axis L2, L2' of the nozzle orifice 2*c* in precisely this view delimit an angle γ in the range of >0° to 60°. The thus tilted arrangement of all the nozzle orifices 2*c*' of the gas injection unit 2 in the same direction causes a swirl to be superimposed on a gas 7 flowing out of the gas injection unit 2, thereby producing a further improvement in the mixing of gas 7 and suspension. The gas distributor nozzles 2*c* according to the embodiment variant shown in FIGS. 1 to 3 can also be disposed in a tilted arrangement of said kind.

Figure 5:
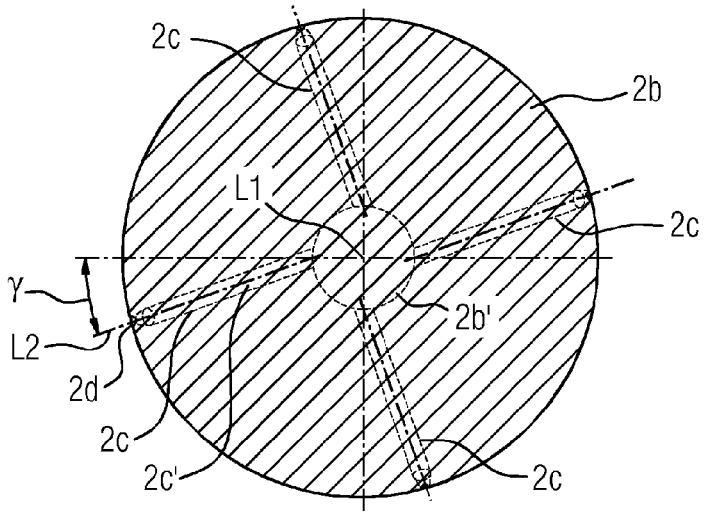
FIG. 5 shows the further gas injection unit in cross-section from above.

FIG. 5 shows the further gas injection unit 2 in cross-section from above, the arrangement and alignment of the gas distributor nozzles 2*c* being more clearly identifiable.

Figure 6:
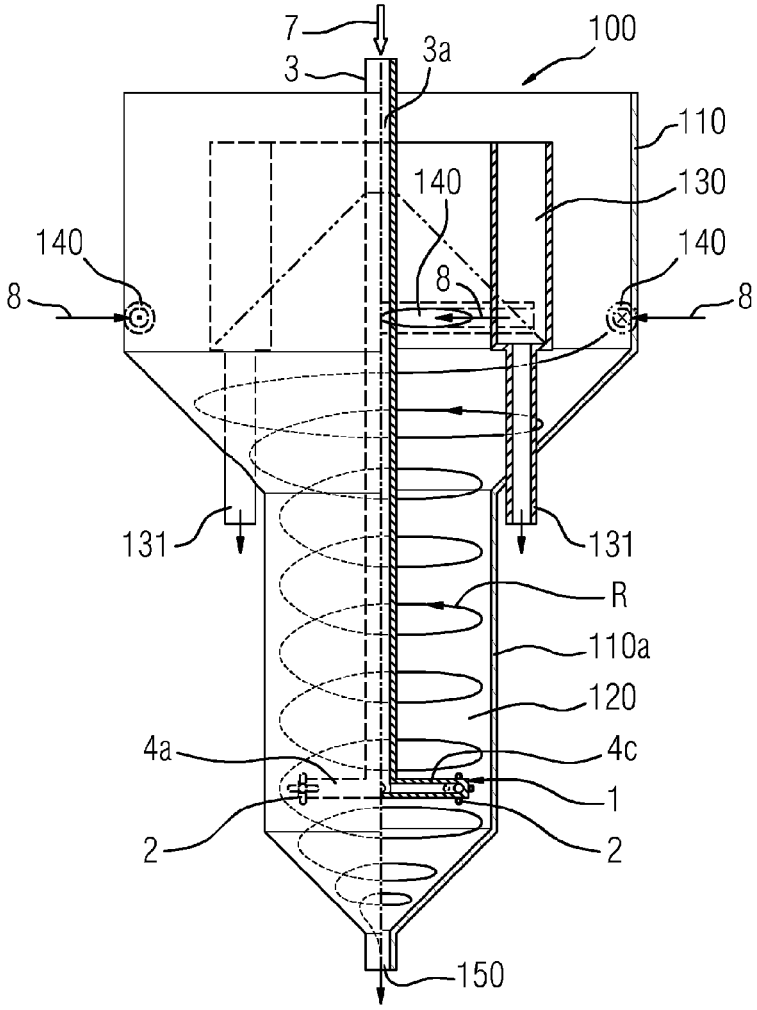
FIG. 6 schematically shows a pneumatic flotation cell in a partial longitudinal section.

FIG. 6 shows a column-shaped flotation cell 100, in this case a hybrid flotation cell, having a housing 110 which comprises a flotation chamber 120. The left side of the flotation cell 100 is shown in a front view, the right side in section. Located inside the flotation chamber 120 is a foam channel 130 having discharge ports 131 for discharging the foam product formed. The flotation chamber 120 is equipped with nozzle arrangements 140 for feeding a mixture 8 composed of gas, in particular air, and a suspension comprising valuable resource particles that are to be separated off, into the flotation chamber 120.

In this case the suspension has a high solid matter content in the range of 20 to 60%, in particular of 30 to 40%.

The housing 110 has a cylindrical housing section 110*a* into the center of which the first sparging arrangement 1 according to FIG. 1 is inserted. The housing 110 additionally has a bottom discharge opening 150. The top edge of the outer wall of the housing 110 is located above the top edge of the foam channel 130, thereby precluding an overflow of the formed foam product over the top edge of the housing 110. Particles of the suspension which are provided for example with an insufficiently hydrophobized surface or which have not collided with a gas bubble, as well as hydrophilic particles, sink in the direction of the bottom discharge opening 150 and are discharged via said opening. Additional gas 7, in particular air, is blown into the cylindrical housing section 110*a* by means of the first sparging device 1, with the result that further hydrophobic particles are bound thereto and rise to the surface.

The alignment of at least some of the gas outlet orifices 2*d* of the respective gas injection units 2 in such a way that the gas 7 is injected counter to the helical direction of movement R of the suspension ensures an intensive mixing of suspension and gas bubbles, thereby increasing the yield of the flotation cell 100. At the same time the position of the gas injection units 2 can be adjusted upward or downward in the direction of the longitudinal axis LZ of the central conduit 3 and optimized in the process.

In the ideal case, the hydrophilic particles in particular sink down further and are discharged via the bottom discharge opening 150. The foam product containing the valuable resource particles moves from the flotation chamber 120 into the foam channel 130 and is discharged via the discharge ports 131 and if necessary thickened.

Figure 7:
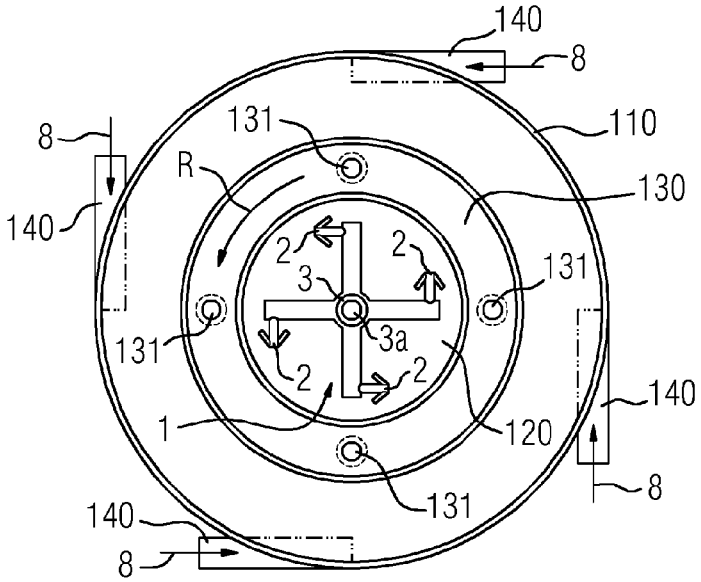
FIG. 7 shows a plan view onto the pneumatic flotation cell according to FIG. 6.

FIG. 7 shows the flotation cell 100 in a plan view, the position of the first sparging device 1 in the flotation chamber 120 being visible.

Ideally a suspension having a solid matter content in the range of 20 to 60%, in particular 30 to 40%, comprising particles having a maximum particle diameter, is subjected to flotation treatment in the flotation cell 100. In this case the diameter of the gas outlet orifices 2*d* lies in the range of 1 to 5 mm.

The sparging devices and flotation cells shown in the figures are merely representative examples from a multiplicity of further possible embodiments of sparging devices and flotation cells provided therewith. A person skilled in the art can also equip other flotation cells with one sparging device or a suitable number of sparging devices.

Accordingly, flotation cells suitable for the application of a sparging device can be different in terms of the embodiment and arrangement of the flotation chamber, the foam collector, the number of nozzle arrangements for injecting suspension and gas, etc., without departing from the scope of the present disclosure. Furthermore, the sparging devices can comprise a different number of gas distributor nozzles, nozzle orifices, gas outlet orifices, connecting tubes and the like, wherein the arrangement thereof and alignment with respect to one another can vary.

What is claimed is:

1. A sparging device for a flotation cell, comprising:

a central gas conduit having a central gas orifice, at least two connecting tubes connected to the central gas conduit, each connecting tube having a connecting gas orifice, wherein the connecting tubes are aligned at a right angle β to a longitudinal axis LZ of the central gas conduit, wherein the central gas orifice is connected to the connecting gas orifices, wherein each connecting tube has an end facing away from the central gas conduit that is connected to at least one gas injection unit, wherein each gas injection unit comprises a gas feed tube having a gas feed orifice leading into a gas distributor chamber of a gas distributor, wherein the gas distributor further comprises a number of gas distributor nozzles, each having at least one tubular nozzle orifice and at least one gas outlet orifice, wherein each nozzle orifice is connected on one side to the gas distributor chamber and on another side to at least one gas outlet orifice at an end of the gas distributor nozzle facing away from the gas feed tube, wherein the gas distributor nozzles are arranged equidistantly from one another around a longitudinal axis of the gas feed tube, viewed in a direction of the longitudinal axis, and a longitudinal axis of each nozzle orifice is aligned at an angle of less than 90° to the longitudinal axis of the gas feed tube in a direction of the end of the gas feed tube facing away from the gas distributor, and wherein the connecting gas orifices are connected to the nozzle orifices.

2. The sparging device of claim 1, wherein the longitudinal axis of each nozzle orifice is aligned at an angle in the range of 30° to 70° to the longitudinal axis of the gas feed tube.

3. The sparging device of claim 2, wherein per gas distributor nozzle the longitudinal axis of the nozzle orifice and the longitudinal axis of the gas feed tube are arranged in one plane.

4. The sparging device of claim 1, wherein each gas outlet orifice has a diameter in the range of 1 mm to 5 mm.

5. The sparging device of claim 1, wherein two connecting tubes in each case are arranged opposite each other at the central gas conduit and symmetrically with respect to a longitudinal axis of the central gas conduit.

6. The sparging device of claim 1, wherein the longitudinal axis of each gas feed tube is aligned at a right angle to a longitudinal axis of the respective connecting tube.

7. A flotation cell, comprising:

a housing having a flotation chamber, at least one nozzle arrangement for feeding gas and a suspension into the flotation chamber, and at least one sparging device for further feeding of gas into the flotation chamber, each sparing device comprising:

a central gas conduit having a central gas orifice, at least two connecting tubes connecting to the central gas conduit, each connecting tube having a connecting gas orifice, wherein the connecting tubes are aligned at a right angle to a longitudinal axis LZ of the central gas conduit, wherein the central gas orifice is connected to the connecting gas orifices, wherein each connecting tube has an end facing away from the central gas conduit that is connected to at least one gas injection unit, wherein each gas injection unit comprises a gas feed tube having a gas feed orifice leading into a gas distributor chamber of a gas distributor, wherein the gas distributor further comprises a number of gas distributor nozzles, each. having at least one tubular nozzle orifice and at least one gas outlet orifice, wherein each nozzle orifice is connected on one side to the gas distributor chamber and on another side to at least one gas outlet .orifice at an end of the gas distributor nozzle facing away from the gas feed tube, wherein the gas distributor nozzles are arranged equidistantly from one another around a longitudinal axis of the gas feed tube, viewed in a direction of the longitudinal axis, and a longitudinal axis of each nozzle orifice is aligned at an angle of less than 90° to the longitudinal axis of the gas feed tube in a direction of the end of the gas feed tube facing away from the gas distributor, wherein the connecting gas orifices are connected to the nozzle orifices, and wherein each gas injection unit is arranged in said manner in the flotation chamber underneath the at least one nozzle arrangement.

8. The flotation cell of claim 7, wherein the central gas conduit is arranged vertically and the connecting tubes are arranged horizontally in the flotation chamber.

9. A method for separating valuable resource particles, in particular ore minerals, by flotation from a suspension having a solid matter content in the range of 20 to 60% while forming a foam product by means of a flotation cell as claimed in claim 7, wherein at least some of the gas outlet orifices are aligned counter to a local direction of movement R of the suspension in the housing, and wherein the longitudinal axes of the gas feed tubes are aligned at an angle of 0° to max. 90° to the local direction of movement of the suspension in the housing.

10. The method of claim 9, wherein the longitudinal axes of the gas feed tubes are arranged at an angle in the range of 0° to 20° to the local direction of movement of the suspension in the housing and oppositely directed thereto.

* * * * *